US009637882B2

(12) United States Patent
Wissmann

(10) Patent No.: US 9,637,882 B2
(45) Date of Patent: May 2, 2017

(54) METHOD AND APPARATUS FOR MAKING AN EXPANDED BASE PIER

(71) Applicant: Geopier Foundation Company, Inc., Davidson, NC (US)

(72) Inventor: Kord J. Wissmann, Mooresville, NC (US)

(73) Assignee: GEOPIER FOUNDATION COMPANY, INC., Davidson, NC (US)

( * ) Notice: Subject to any disclaimer, the term of this patent is extended or adjusted under 35 U.S.C. 154(b) by 0 days.

(21) Appl. No.: 15/175,680

(22) Filed: Jun. 7, 2016

(65) Prior Publication Data

US 2016/0312430 A1 Oct. 27, 2016

Related U.S. Application Data

(63) Continuation-in-part of application No. 12/875,986, filed on Sep. 3, 2010, now abandoned.

(Continued)

(51) Int. Cl.

| | |
|---|---|
| ***E02D 5/34*** | (2006.01) |
| ***E02D 5/38*** | (2006.01) |
| ***E02D 3/08*** | (2006.01) |
| ***E02D 5/44*** | (2006.01) |
| ***E02D 5/46*** | (2006.01) |

(52) U.S. Cl.

CPC ..... *E02D 5/385* (2013.01); *E02D 3/08* (2013.01); *E02D 5/44* (2013.01); *E02D 5/46* (2013.01)

(58) Field of Classification Search

USPC ..... 405/231, 232, 233, 236, 266, 267, 271; 175/19

See application file for complete search history.

(56) References Cited

U.S. PATENT DOCUMENTS

| | | | |
|---|---|---|---|
| 3,832,857 | A | 9/1974 | Bassett |
| 4,158,518 | A | 6/1979 | Rusche |

(Continued)

FOREIGN PATENT DOCUMENTS

| | | |
|---|---|---|
| JP | 03-028416 | 2/1991 |

OTHER PUBLICATIONS

Juan Rodriguez, Backfilling: Backfill Methods; About.com Construction; 1 page; http://construction.about.com/od/New-Airports-Construction/a/Backfilling-Backfill-Methods.htm; publication date unknown but believed to be before filing date of Sep. 3, 2010.

*Primary Examiner* — Sean Andrish

(74) *Attorney, Agent, or Firm* — Nexsen Pruett PLLC; E. Eric Mills

(57) ABSTRACT

A system for constructing a support column includes a mandrel with an upper portion and a tamper head. A feed tube extends through the mandrel for feeding flowable material to the head. The tamper head includes a lower enlarged chamber with a reducing surface at an upper portion and includes a plurality of chain links for compacting material and restricting upward flow of aggregate. The tamper head is of a size providing an enclosed region for allowing cementitious materials to be placed therein. A non-moveable sealed top plate and a separate flowable material supply tube is included via a sealed connection. A pressure gauge for monitoring air pressure within the tube portion is included and allows a support column including a cementitious inclusion on top of an expanded base to be built with a known unitary expanded base volume calculated based on pressure drop indications.

8 Claims, 11 Drawing Sheets

Related U.S. Application Data

(60) Provisional application No. 61/239,649, filed on Sep. 3, 2009.

(56) References Cited

U.S. PATENT DOCUMENTS

| | | | |
|---|---|---|---|
| 4,730,954 | A | 3/1988 | Sliwinski et al. |
| 4,992,002 | A | 2/1991 | DeWitt |
| 5,217,320 | A | 6/1993 | Cioffi |
| 5,249,892 | A | 10/1993 | Fox et al. |
| 5,697,734 | A | 12/1997 | Verstraeten |
| 6,354,766 | B1 | 3/2002 | Fox |
| 6,425,713 | B2 | 7/2002 | Fox et al. |
| 7,226,246 | B2 | 6/2007 | Fox |
| 7,326,004 | B2 | 2/2008 | Wissmann et al. |
| 7,604,437 | B2 | 10/2009 | Wissmann et al. |
| 2004/0115011 | A1 | 6/2004 | Fox |
| 2006/0088388 | A1 | 4/2006 | Wissmann et al. |
| 2008/0205993 | A1 | 8/2008 | Wissmann et al. |

METHOD AND APPARATUS FOR MAKING AN EXPANDED BASE PIER

CROSS REFERENCE TO RELATED APPLICATIONS

This application is related to and claims the priority of U.S. Utility patent application Ser. No. 12/875,986, filed Sep. 3, 2010 which in turn is related to and claims the priority of U.S. Provisional Patent Application Ser. No. 61/239,649, filed Sep. 3, 2009; the disclosures of which are incorporated by reference in their entirety.

FIELD OF THE INVENTION

The present invention relates to construction of a structural support column. More specifically, the present invention relates to a method and apparatus for building an expanded base pier to bypass weak soils and transfer structural loads to underlying strong soils.

BACKGROUND OF INVENTION

Heavy or settlement-sensitive facilities that are located in areas containing soft or weak soils are often supported on deep foundations, consisting of driven piles or drilled concrete columns. The deep foundations are designed to transfer the structure loads through the soft soils to more competent soil strata.

In recent years, aggregate columns have been increasingly used to support structures located in areas containing soft soils. The columns are designed to reinforce and strengthen the soft layer and minimize resulting settlements. The columns are constructed using a variety of methods including the drilling and tamping method described in U.S. Pat. Nos. 5,249,892 and 6,354,766; the driven mandrel method described in U.S. Pat. No. 6,425,713; the tamper head driven mandrel method described in U.S. Pat. No. 7,226,246; and the driven tapered mandrel method described in U.S. Pat. No. 7,326,004; the disclosures of which are incorporated by reference in their entirety.

The short aggregate column method (U.S. Pat. Nos. 5,249,892 and 6,354,766), which includes drilling or excavating a cavity, is an effective foundation solution when installed in cohesive soils where the sidewall stability of the hole is easily maintained. The method generally consists of: a) drilling a generally cylindrical cavity or hole in the foundation soil (typically around 30 inches); b) compacting the soil at the bottom of the cavity; c) installing a relatively thin lift of aggregate into the cavity (typically around 12-18 inches); d) tamping the aggregate lift with a specially designed beveled tamper head; and e) repeating the process to form an aggregate column generally extending to the ground surface. Fundamental to the process is the application of sufficient energy to the beveled tamper head such that the process builds up lateral stresses within the matrix soil up along the sides of the cavity during the sequential tamping. This lateral stress build up is important because it decreases the compressibility of the matrix soils and allows applied loads to be efficiently transferred to the matrix soils during column loading.

The tamper head driven mandrel method (U.S. Pat. No. 7,226,246) is a displacement form of the short aggregate column method. This method generally consists of driving a hollow pipe (mandrel) into the ground without the need for drilling. The pipe is fitted with a tamper head at the bottom which has a greater diameter than the pipe and which has a flat bottom and beveled sides. The mandrel is driven to the design bottom of column elevation, filled with aggregate and then lifted, allowing the aggregate to flow out of the pipe and into the cavity created by withdrawing the mandrel. The tamper head is then driven back down into the aggregate to compact the aggregate. The flat bottom shape of the tamper head compacts the aggregate; the beveled sides force the aggregate into the sidewalls of the hole thereby increasing the lateral stresses in the surrounding ground.

The driven tapered mandrel method (U.S. Pat. No. 7,326,004) is another means of creating an aggregate column with a displacement mandrel. In this case, the shape of the mandrel is a truncated cone, larger at the top than at the bottom, with a taper angle of about 1 to about 5 degrees from vertical. The mandrel is driven into the ground, causing the matrix soil to displace downwardly and laterally during driving. After reaching the design bottom of the column elevation, the mandrel is withdrawn, leaving a cone shaped cavity in the ground. The conical shape of the mandrel allows for temporarily stabilizing of the sidewalls of the hole such that aggregate may be introduced into the cavity from the ground surface. After placing a lift of aggregate, the mandrel is re-driven downward into the aggregate to compact the aggregate and force it sideways into the sidewalls of the hole. Sometimes, a larger mandrel is used to compact the aggregate near the top of the column.

U.S. Pat. No. 7,604,437 is related to a mandrel for making aggregate support columns wherein flow restrictors are provided to prevent upward movement of aggregate through the mandrel during driving of the mandrel. The mandrel contemplated in this art relates to formation of an aggregate support column such as described in U.S. Pat. Nos. 6,425,713 and 7,226,246 discussed above.

U.S. Pat. Nos. 4,992,002 and 6,773,208 relate to methods for casting a partially reinforced concrete pier in the ground. One method involves the use of an elongate mandrel with a cupped foot having a larger cross-sectional area than the mandrel, wherein flowable grout that is placed in the mandrel flows through openings located near the bottom of the mandrel into the space between the mandrel and the foot. The other method involves the installation of an elongate hollow tubular casing that is then filled with fluid concrete that is allowed to set while the casing remains in the ground. Each of these references is merely to concrete hardened inclusions and does not allow for the additional stability and strength provided by a pier that has an expanded base.

In the area of soil improvement, it is often desirable to install a stiff inclusion into the ground to transfer loads through a soft or weak soil layer. Although these soil layers may also be treated by non-cementitious aggregate columns, non-cementitious columns are typically confining-stress dependent (i.e., they rely on the strength of the sidewall soils to prevent bulging). Occasionally, it is desirable to utilize cementitious inclusions to bypass weak soils and transfer loads to underlying strong soils. The object of the present invention is to efficiently form a strong and stiff expanded base (either cementitious or non-cementitious) at the bottom of the column and to provide an efficient means for the introduction of grout, concrete, post-grouted aggregate, or other cementitious material through the upper portions of the column to form a cementitious inclusion.

BRIEF DESCRIPTION OF INVENTION

The present invention relates to a system for constructing a support column. A mandrel has an upper portion and a tamper head. A feed tube extends through the mandrel for feeding aggregate, concrete, grout, or other flowable materials to the tamper head. The tamper head includes a lower enlarged chamber with a reducing surface at an upper portion thereof for compacting aggregate or concrete and restricting upward flow of aggregate or concrete during compaction. The tamper head is of a size providing an enclosed region for allowing cementitious materials to be placed therein.

The invention may comprise a valve mechanism movable between an open position and a closed position for closing off the feed tube from communication with the tamper head during tamping operations and may comprising stiffening members secured between the reducing surface and the mandrel for providing load support during tamping operations. The invention may further comprise chains attached or notches within the interior of the tamper head for restricting upward flow of material into the feed tube during downward movement of the mandrel. A second tube may extend through the mandrel on the side of the feed tube for allowing cementitious material to flow upward through the second tube for inspection of the cementitious material during pumping. A hopper may be located at the top of the mandrel for feeding aggregate into the feed tube of the mandrel. A closure cap may be on an end of the feed tube opposite the tamper head and a concrete supply tube may be connected to the feed tube, and an air pressure source may be connected to the feed tube for evacuating concrete from the feed tube through air pressure supplied thereto.

A method of constructing such support columns with the system is also disclosed and may include providing the tamper head of a shape with a defined lower enlarged chamber having a reducing surface at an upper portion thereof for compaction and for restricting upward flow of material into the feed tube during tamping, the tamper head further sized to provide an enclosed region for allowing cementitious material to be placed therein; driving the mandrel assembly into a ground surface to a given depth thereby forming a cavity; lifting the mandrel assembly to release an initial charge of aggregate or concrete from the tamper head into a bottom of the cavity; re-driving the mandrel assembly to compact the aggregate or concrete at a bottom of the cavity and to form an expanded base, the expanded base having a width greater than the tamper head; and withdrawing the mandrel assembly while continuously feeding cementitious material or aggregate to be subsequently fully or partially treated with grout through the feed tube, thereby forming a cementitious inclusion at least partially within the cavity, the cementitious inclusion having a width of the cavity and being formed on top of the expanded base.

The method may further comprise introducing a pipe through the feed tube and tamper head after formation of the expanded base, placing aggregate during the withdrawing step to partially surround the pipe, and introducing cementitious material into the pipe following aggregate placement to treat the aggregate.

A method of constructing an expanded base pier with known expanded base volume is also disclosed. The method includes providing a mandrel assembly comprising a single-wall tube portion and a tamper head, the tube portion having an exterior diameter, wherein the tube portion is connected to the tamper head at an opening thereof for allowing flowable material to flow into the tamper head, and wherein the tamper head comprises a defined lower enlarged chamber having an interior diameter greater than the exterior diameter of the tube portion and further comprising a reducing surface at an upper portion thereof and comprising a plurality of chain links for compaction and for restricting upward flow of the flowable material into the tube portion during tamping, the tamper head further sized to provide an enclosed region for allowing the flowable material to be placed therein. The method also includes providing a non-moveable sealed top plate on an end of the tube portion opposite the tamper head and a separate flowable material supply tube coupled to the tube portion via a sealed connection; providing a pressure gauge for monitoring air pressure within the tube portion; driving the mandrel assembly having an initial volume of the flowable material into a ground surface to a given depth thereby forming a cavity; lifting the mandrel assembly to release the initial volume of the flowable material from the tamper head into a bottom of the cavity while adding a secondary volume of flowable material; re-driving the mandrel assembly wherein the plurality of chain links constrict and restrict to compact the initial and secondary volumes of flowable material at a bottom of the cavity and to form a unitary expanded base, the expanded base having a width greater than the width of the tamper head; measuring air pressure within the tube portion during the driving, lifting, and re-driving steps to determine a pressure drop indication; calculating a unitary expanded base volume based on the pressure drop indication and initial and secondary volumes added for comparison with a design expanded base volume; and upon reaching the design expanded base volume, withdrawing the mandrel assembly while continuously discharging cementitious material from the tamper head, thereby forming, after curing, a stiff cementitious inclusion having a width substantially equal to the width of the cavity and being formed above the expanded base.

The tamper head in the method may be filled with the initial charge of the flowable material before driving.

The method may further include introducing the flowable material into the enclosed region.

The method may further include providing the mandrel assembly with a second tube adjacent the tube portion and fluidly connected to the enlarged chamber to allow for an inspection of the flowable material during pumping.

The method may further include providing an air pressure source connected to the feed tube for evacuating flowable material from the feed tube through air pressure supplied thereto.

The flowable material may include one or more of aggregate, concrete, grout, and cementitious material.

The method may further include providing an air pressure release valve for reducing pressure in the feed tube or providing a pressure gauge for monitoring pressure within the feed tube.

An apparatus for constructing an expanded base pier with known expanded base volume is also disclosed and includes a mandrel assembly comprising a single-wall tube portion and a tamper head, the tube portion having an exterior diameter, wherein the tube portion is connected to the tamper head at an opening thereof for allowing flowable material to flow into the tamper head, and wherein the tamper head comprises a defined lower enlarged chamber having an interior diameter greater than the exterior diameter of the tube portion and further comprising a reducing surface at an upper portion thereof and comprising a plurality of chain links for compaction and for restricting upward flow of the flowable material into the tube portion during tamping, the tamper head further sized to provide an enclosed region for allowing the flowable material to be placed therein; a non-moveable sealed top plate on an end of the tube portion opposite the tamper head and a separate flowable material supply tube coupled to the tube portion via a sealed connection; and a pressure gauge for monitoring air pressure within the tube portion during driving, lifting, and re-driving steps of constructing an expanded base pier to determine a pressure drop indication for calculating a unitary expanded base volume based on the pressure drop indication and initial and secondary volumes added for comparison with a design expanded base volume.

BRIEF DESCRIPTION OF THE DRAWINGS

The invention will be better understood from the following detailed description made with reference to the drawings, wherein:

FIGS. 6A-6F illustrate an alternate method of constructing a pier with one embodiment of the mandrel of the invention;

DETAILED DESCRIPTION OF THE INVENTION

With reference to the attached figures, various embodiments of a new and novel mandrel for forming an expanded base pier, as part of a hardened inclusion, is provided.

Figure 1:
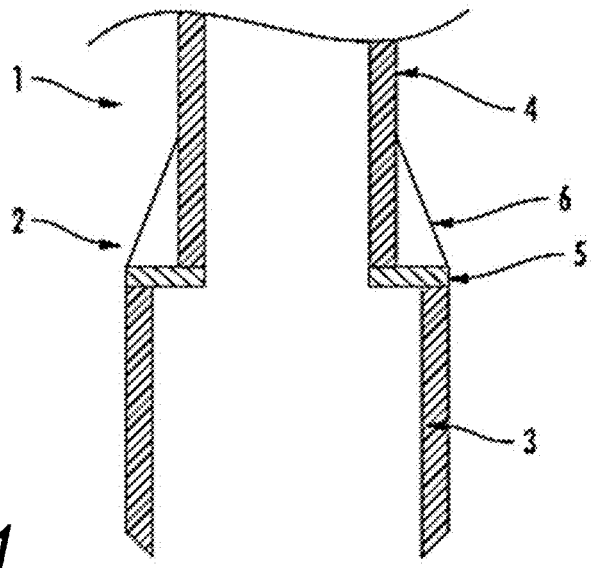
FIG. 1 is a side cross-section view of a first embodiment of a mandrel.
Figure 2:
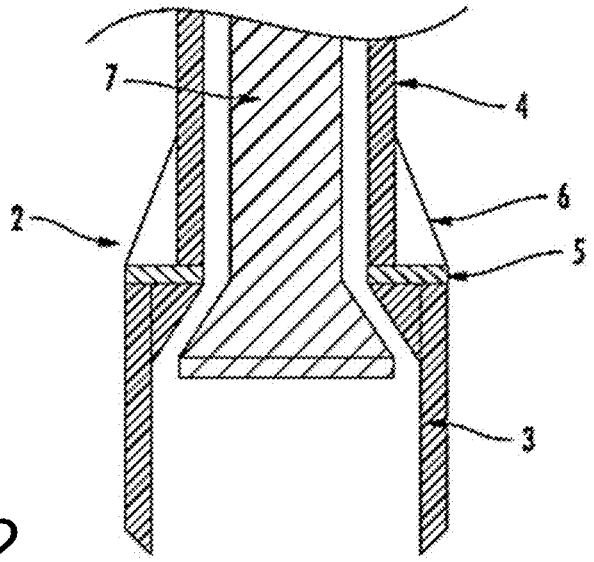
FIG. 2 is a side cross-section view of a second embodiment of the mandrel with a valve.

FIG. 1 illustrates an embodiment of a base mandrel assembly (1) contemplated herein. In this embodiment, a tamper head (2) is formed as a unitary structure attached to one end of a mandrel feed tube or feed pipe (4) to form the mandrel assembly (1). The feed pipe (4) can typically be 4" to 12" in diameter and has an upper end (not shown) opposite the tamper head (2) in which aggregate, concrete, grout, and other flowable material can be fed. The tamper head (2) typically comprises an enlarged lower chamber (3), typically 10" to 24" in diameter. The reducing surface (5) from the lower chamber walls to the feed pipe walls serves the function as a compaction plate for compacting aggregate or concrete as described hereinbelow, as well as serving as an upward flow restrictor while the initial aggregate is being driven such that the aggregate or concrete forms a "plug" within the chamber (3) and does not flow back up into the feed pipe (4). The reducing surface (5) may be angled as shown in FIG. 2. The lower chamber (3) at the bottom of the head allows for formation of a densified bottom expanded base and provides an enclosed area for the placement of grout or concrete. Stiffeners (6) can also be placed between the feed pipe (4) and lower chamber (3) to assist in load transfer during driving.

FIG. 2 illustrates an embodiment of a base mandrel similar to FIG. 1, but includes a special mechanical valve mechanism (7) that may be used to further block the flow of aggregate or concrete from the lower chamber (3) into the feed pipe (4). The valve mechanism (7) seats against the reducing surface (5) of the feed pipe (4) and physically restricts the flow of aggregate, or concrete, back up into the feed pipe during downward driving (as opposed to the "plug" formed as described above with reference to FIG. 1). When the feed pipe (4) is lifted, the mechanical valve mechanism (7) opens to allow the downward flow of grout, concrete, or other flowable material through the feed pipe (4) and into the lower chamber (3). The mechanical valve mechanism (7) may be manipulated by a pipe extending to the top of the mandrel or by a mechanism that pins the valve mechanism (7) to the sidewalls of the feed pipe (4).

The purpose of the valve mechanism (7) envisioned with reference to FIG. 2 is to allow subsequent compaction of the bottom aggregate or concrete expanded base initially placed and formed. For instance, the mandrel would first be driven in the ground with the lower chamber (3) charged with aggregate or concrete. The feed pipe (4) would then be lifted, and the mechanical valve mechanism (7) would open. Grout or concrete would then be added through the feed pipe (4). The mechanical valve mandrel assembly (1) would then be driven back down, thereby allowing for further compaction of the aggregate or concrete at the bottom to form an expanded base.

Figure 3:
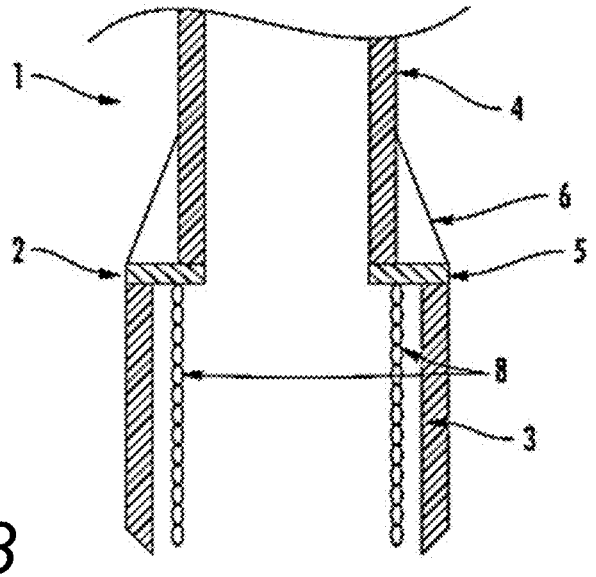
FIG. 3 is a side cross-section view of a third embodiment of the mandrel with internal upward flow restrictors.

FIG. 3 illustrates another variation of the embodiment of FIG. 1. More specifically, restrictor elements such as chain links (8) are attached within the tamper head (2) so that upon tamping, the chain links (8) move inward to constrict the aggregate or concrete in the lower chamber (3) and restrict aggregate or concrete from flowing upward into the feed tube (4). It is also envisioned that internal notches may be provided in lieu of chains in order to provide non-mechanical (or passive) upward flow restriction.

Figure 4:
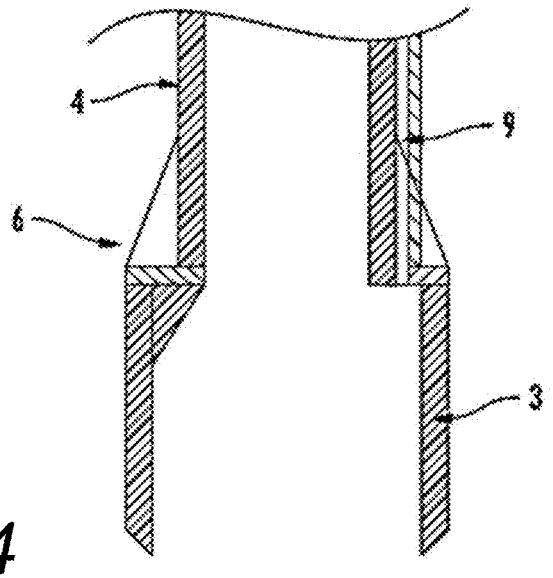
FIG. 4 is a side cross-section view of a fourth embodiment of the mandrel with a grout return pipe.

FIG. 4 illustrates a further embodiment of a mandrel similar to that shown in FIG. 1 but which includes a special provision for ensuring grout placement. Instead of having only a single chute feed pipe or tube (4) as shown in FIG. 1, the embodiment contemplated with reference to FIG. 4 has a feed pipe including a mandrel feed pipe (4) and a grout return pipe (9) that is used to ensure that a continuous column of grout is installed. Positive flow of grout from the top of the grout return pipe (9) demonstrates that the mandrel is full of grout before or during mandrel extraction (lifting) operations.

A method of use is shown with reference to FIGS. 5A-5E, which shows an installation sequence with the base mandrel depicted in FIG. 1. Step A (FIG. 5A) shows placing a mound (10) of the aggregate on the ground surface. Step B (FIG. 5B) shows driving the mandrel assembly (1) through the mound (10) of aggregate (to form an initial charge of aggregate) and to the final driving elevation. During the driving process, the aggregate (and chain links (8) in a constrict/restrict "bunched" form) in the lower chamber (3) forms a plug (11) in the neck of the feed pipe (4) at the bottom of the tamper head (2). The valve mechanism (7) shown in FIG. 2 or the chain links (8) shown in FIG. 3 may be used within the tamper head (2) to facilitate plugging. Step C (FIG. 5C) shows lifting of the mandrel assembly (1)

wherein the aggregate plug (11) or initial charge remains in place at the bottom of the hole (it is understood that the initial charge may also be added after driving of a closed tamper head, such as with a sacrificial cap covering the bottom opening of the tamper head). Step D (FIG. 5D) shows re-driving the mandrel assembly (1) one or more times to compact the aggregate at the bottom of the hole and to form an expanded base (12). Grout or concrete (13) may then be pumped through the feed pipe as shown. Step E (FIG. 5E) shows placing grout or concrete (13) from the element up from the bottom while removing the mandrel. When the grout return pipe (9) as shown in FIG. 4 is used in conjunction with Step E of the construction process, grout continuity within the mandrel shaft is determined if grout continues to flow out of the grout return pipe (9) during extraction. The finished support column comprises an expanded base with a cementitious inclusion located thereon.

Figures 5A, 5B, 5C, 5D, 5E:
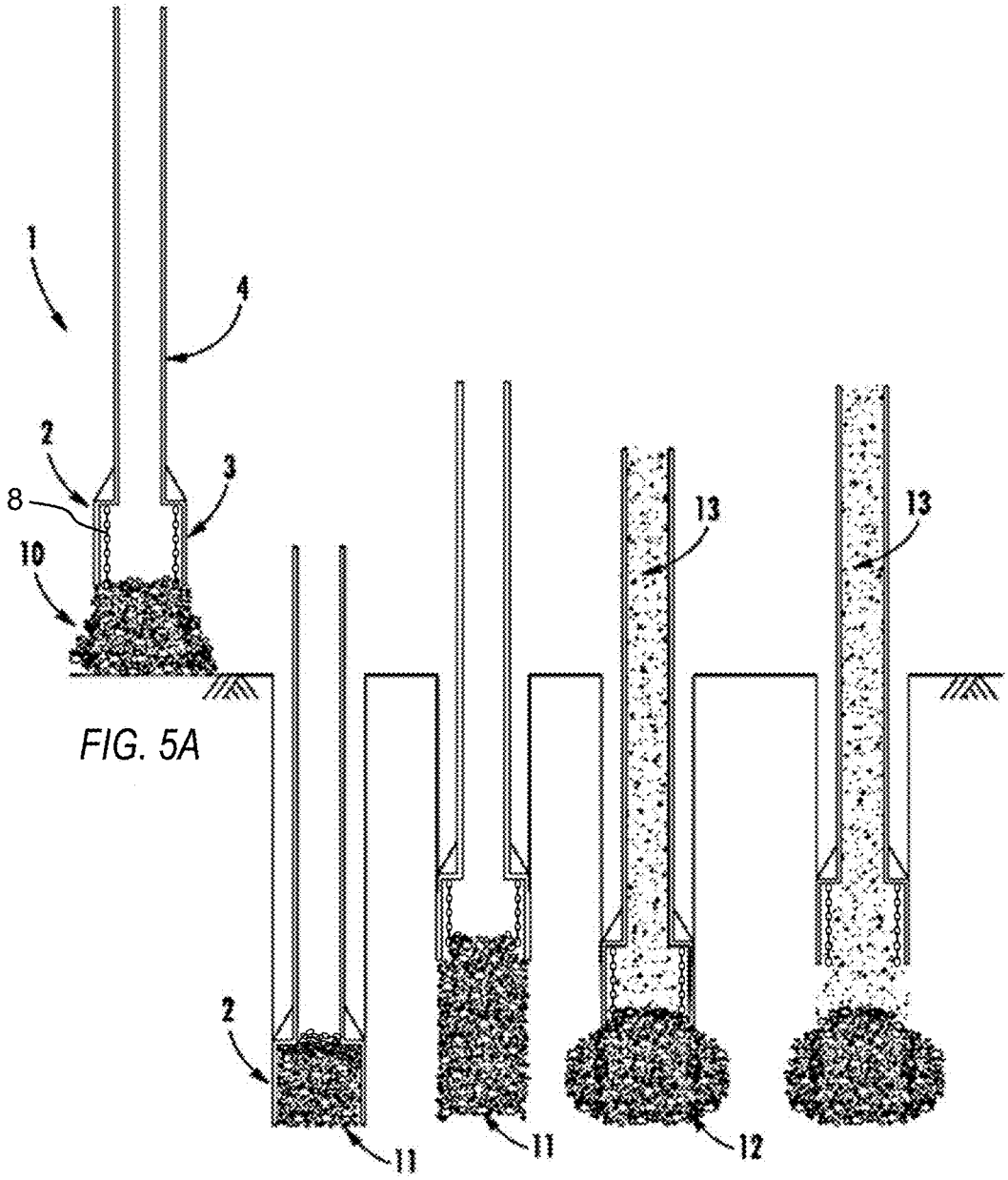
FIGS. 5A-5E illustrate a method of constructing a pier with the mandrel of FIG. 1.

An alternative method of use can also be used with reference to FIGS. 5A-5E. Step A consists of filling the lower chamber (3) of the tamper head (2) with concrete. This may be achieved by driving the tamper head (2) through a mound (10) of concrete as shown in FIG. 5A or by pumping concrete through the feed tube (4) while the tamper head (2) is resting on the ground surface. In this case, the ground surface seals the concrete from flowing out of the bottom of the lower chamber (3). As shown in FIG. 5B, the tamper head (2) with chain links (8) is then driven to design elevation with the concrete at the bottom of the tamper head (2) forming a plug (11) at the bottom of the assembly mandrel (1). The valve mechanism (7) shown in FIG. 2 or the chain links (8) shown in FIG. 3 may be used within the tamper head (2) to facilitate plugging. Step C shows the retraction (lifting) of the assembly (2) to allow the concrete to flow out of the bottom of the tamper head (2). Step D shows the placement of additional concrete (13) through the feed pipe (4) and the subsequent or simultaneous lowering of the mandrel assembly (1) onto the previously placed concrete to force the concrete outward thus forming an expanded base (12). Step E shows the simultaneous placement of grout or concrete (13) through the feed tube (4) while extracting the mandrel assembly (1) to the ground surface. This technique forms an expanded base pier comprised of concrete at the expanded base (12) and concrete within the pier shaft (or inclusion) on top of the expanded base (12).

The benefits of the system contemplated herein are the efficient formation of an expanded base (12) that allows load to be transferred to the bottom of the pier and the very quick and efficient formation of the grouted inclusion by rapidly raising the mandrel while placing grout or concrete (13). While the method sequence of FIGS. 5A-5E depicts the use of the base mandrel shown in FIG. 1, it is envisioned that the method could principally be used with any of the mandrels shown in FIGS. 1-4.

Figures 6B, 6C, 6D, 6E, 6F:
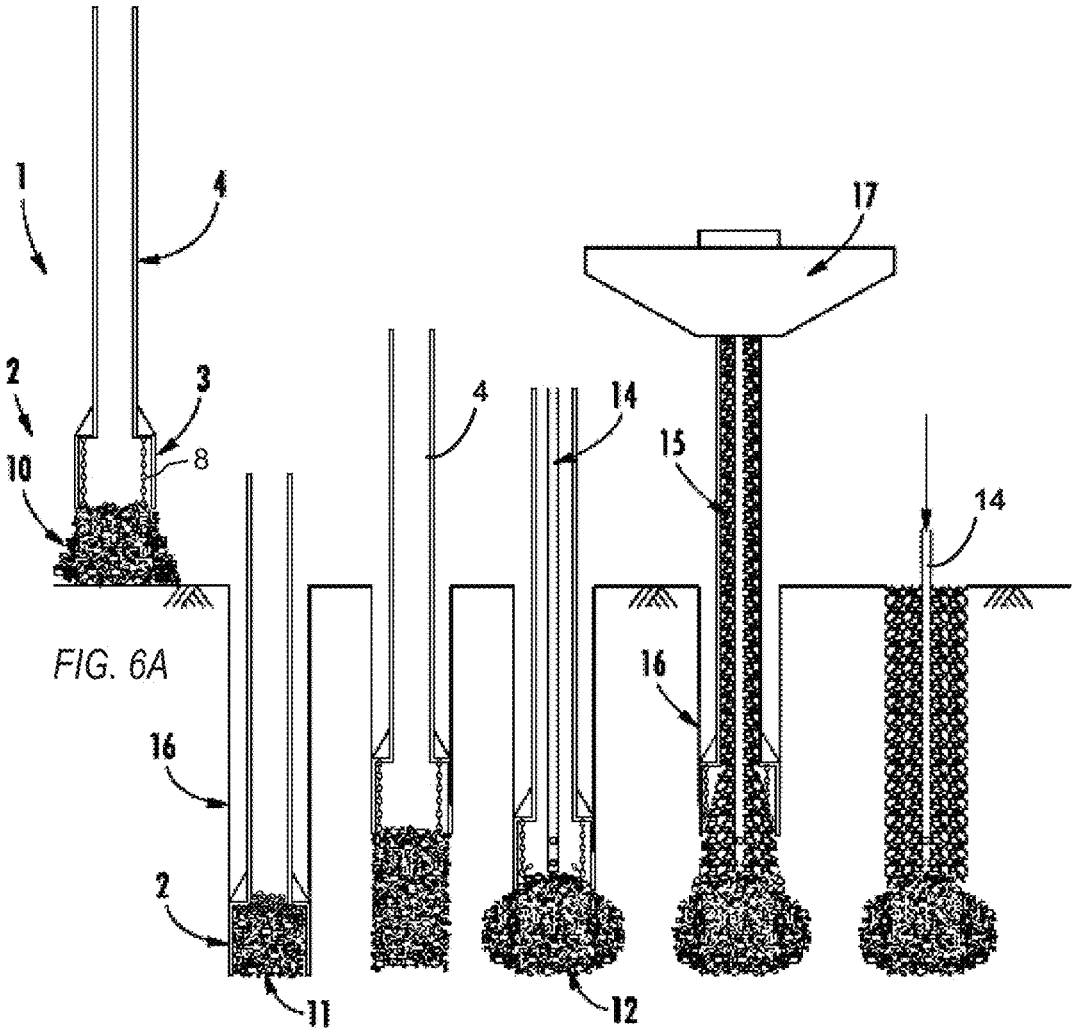

FIGS. 6A-6F shows an alternative construction sequence where Steps A through C (FIGS. 6A-6C) are generally as described above with reference to the initial charge of aggregate being in the lower chamber (see FIGS. 5A-5C). In Step D (FIG. 6D) of this sequence, the mandrel assembly (1) is lowered engaging the chain links (8) to compact the aggregate and a secondary disposable pipe (14) is inserted into the mandrel assembly (1) to rest on the expanded base (12). In Step E (FIG. 6E) the mandrel assembly (1) is raised and additional aggregate (15) is allowed to fill the annular space between the disposable pipe (14) and the sidewall of the cavity (16). A hopper (17) can be used to place the aggregate (15) within the feed pipe (4). The aggregate (15) placed in this step is not compacted. In Step F (FIG. 6F) the disposable pipe (14) is then used as a conduit to place grout into the inclusion by filling the voids in the loose aggregate (15) around the disposable pipe (14). Typically, the disposable pipe (14) is not removed but can be cut at ground level or just below ground level and made part of the permanent inclusion. Additionally, while FIGS. 6D-6F depict representative grout ports at the bottom end of disposable pipe (14), it is understood that such ports or other openings can be located partially or fully along the length of disposable pipe (14).

Figure 7:
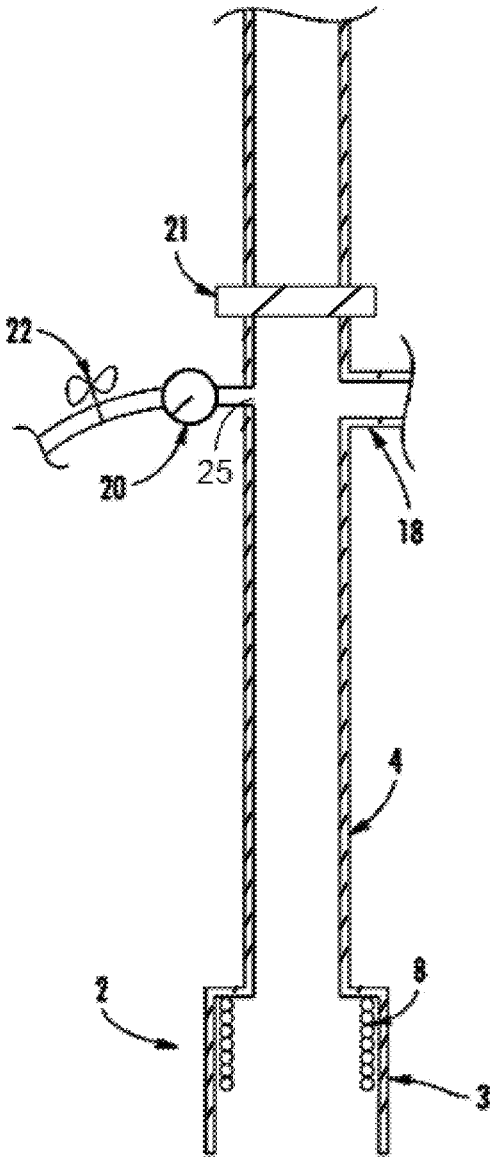
FIG. 7 is a side cross-section view of an alternative embodiment of the mandrel using a closed top system to allow air pressure to build.

FIG. 7 illustrates a further embodiment of a mandrel similar to that shown in FIG. 1 but which includes a closed system for the placement of concrete, grout, or other flowable materials. The mandrel of this embodiment includes an external feed tube (18) that enters the mandrel feed tube (4) near the top of the mandrel to allow for the passage of a flowable material. The external feed tube (18) is used to pump concrete, grout, or other flowable materials into the mandrel feed tube (4). The top of the mandrel is sealed with a top plate (21) making this a closed system. An air pressure gage (20) may optionally be installed to measure the internal air pressure within the mandrel and allow for the use of a pressure release valve (22) to facilitate removal of excess internal pressure during pumping. The mandrel system of FIG. 7 may be used in conjunction with the construction sequences shown in FIGS. 5A-5E.

Figure 8:
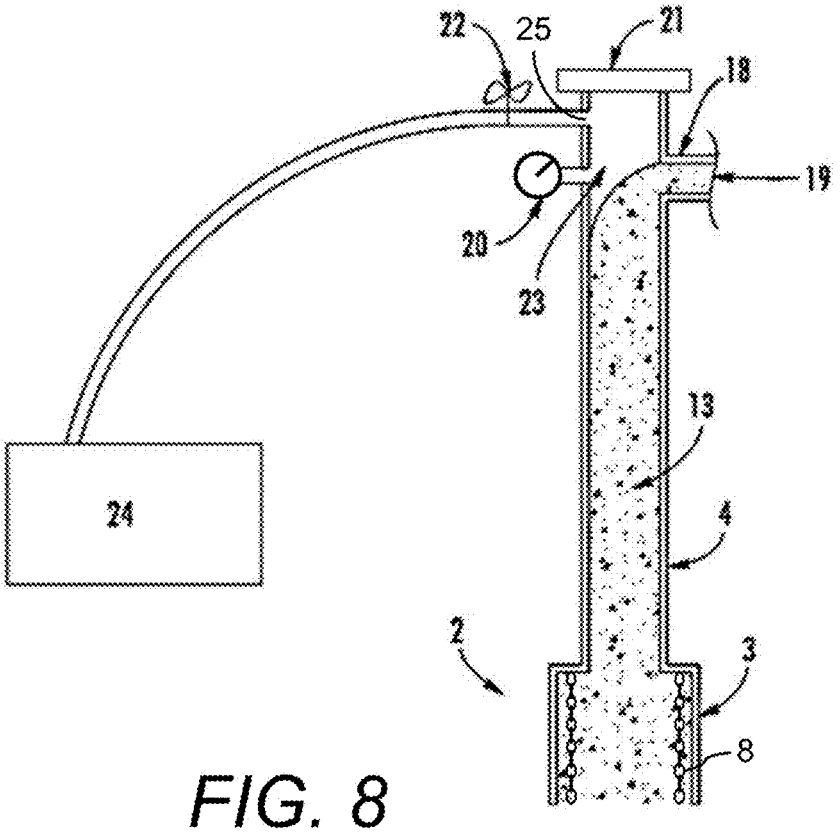
FIG. 8 is a more detailed view of the operation of a closed top system including use of an external air source.

FIG. 8 illustrates yet another embodiment of the mandrel similar to that shown in FIG. 7. In this embodiment, an air source, such as compressor (24), may optionally be used to apply elevated air pressure to trapped air (23) within the mandrel feed pipe (4) to evacuate concrete (13) from the mandrel.

The following examples illustrate further aspects of the invention.

EXAMPLE I

As an example, an embodiment of the system of the present invention was used to install a support column, also described herein as an expanded base pier ("EBP"), at a test site in Iowa. The test site was characterized by 4 feet of sandy lean clay underlain by sand. This testing program was designed to compare the load versus deflection characteristics of this embodiment of the EBP to reference piers constructed in successive lifts, such as a pier constructed by the tamper head driven mandrel method. The reference piers of this example had a nominal diameter of 20 inches and an installed length of 23 feet. One reference pier was constructed of aggregate only to a diameter of 20 inches. Another reference pier was constructed with a grout additive, commonly referred to as grouted pier, to a diameter of 14 inches.

In this embodiment of the invention, the EBP was formed by filling the extractable mandrel (FIG. 3) with a combination of open graded aggregate and fluid grout. The mandrel had a lower chamber (3) outside diameter of 14 inches and a feed pipe (4) outside diameter of 12 inches. The mandrel included the chain links (8) shown in FIG. 3. The mandrel of this embodiment was connected at its open end (opposite the tamper head) to an open hopper for filling and was attached to a high frequency hammer which is often associated with driving sheet piles. The hammer is capable of providing both downward force and vibratory energy. The full mandrel was advanced to a depth of 23 feet below the ground surface. The mandrel assembly was then raised 3 feet and lowered 3 feet a total of 3 times to form a bottom expanded base. Each raising and lowering of the mandrel is referred to as a "stroke." The mandrel was then raised 3 feet, lowered 2 feet, and then slowly extracted to the ground surface allowing a column of grout and aggregate to be placed in the cavity created during mandrel installation. The EBP was constructed with a base diameter of 20 inches, and a shaft diameter of 14 inches. Once the mandrel was fully extracted, a 1 inch diameter reinforcing steel rod was inserted the full length of the EBP. A concrete cap was then poured above the EBP to facilitate load testing.

Figure 9:
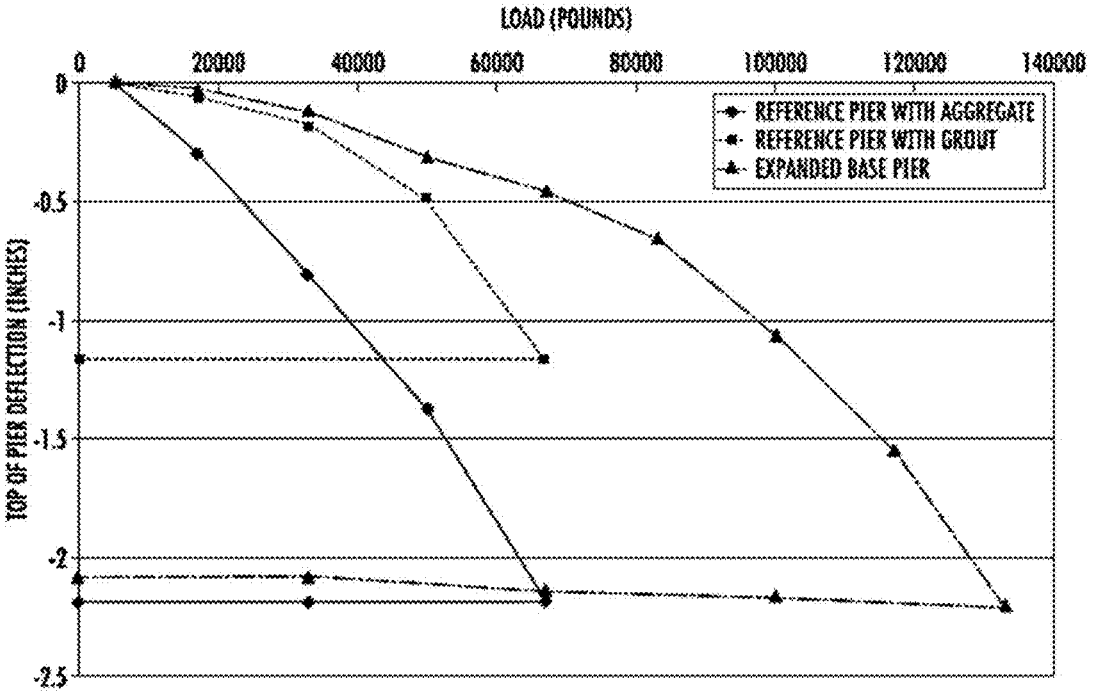
FIG. 9 is a graph showing results of load tests performed on columns made according to Example I as compared to reference piers.

The reference piers and the EBP were load tested using a hydraulic jack pushing against a test frame. FIG. 9 shows the results of the load test of the EBP compared with the reference piers. At a top of pier deflection of 0.5 inches, the reference pier with aggregate supported a load of about 23,300 pounds, the reference pier with grout supported a load of about 50,000 pounds, and the EBP supported a load of about 70,300 pounds. At a top of pier deflection of 1 inch, the reference pier with aggregate supported a load of about 38,800 pounds, the reference pier with grout supported a load of about 62,700 pounds, and the EBP supported a load of about 97,000 pounds. The load carrying capacity of the pier constructed in accordance with this embodiment of the present invention showed a 2.5 to 3 fold improvement when compared to a reference pier with aggregate, and a 1.4 to 1.5 fold improvement when compared to a reference pier with grout. The difference in the behavior relative to the grouted pier is caused by the formation of the bottom expanded base during the construction of the EBP according to the invention.

EXAMPLE II

As another example, the system of another embodiment of the present invention was used to install five EBP elements at a test site in Virginia. The test site was characterized by hard clay. Prior to installation of the EBP, 30 inch diameter drill holes were excavated to a depth of 8 feet below the ground surface. The voids were then loosely backfilled with sand. The EBP elements of this example were formed within the backfilled holes.

In this embodiment of the invention, the EBP was formed by filling the mandrel described in FIG. 7 with concrete. The mandrel of this embodiment featured a "closed top" as opposed to the "open hopper" configuration as described with reference to Example I. The mandrel in this embodiment was attached to a similar hammer as in the embodiment of Example I. The full mandrel was advanced to a depth of 8 feet below the ground surface. The mandrel was then raised 3 feet, and then lowered 2 feet for three repetitions to create the expanded base. A process of raising the mandrel 3 feet, and then lowering 1 foot was then used to complete the full length of the pier. Once the concrete had cured, each of the piers was excavated and the pier base and shaft diameters were measured.

The lower chamber in this embodiment had a nominal 12 inch diameter outer dimension. The excavated and measured piers had an average nominal diameter of 18 inches. Expanded bases at the bottoms of the piers exceeded 24 inches demonstrating the effectiveness of this construction technique.

EXAMPLE III

As yet another example, the embodiment of the present invention from Example II was used on a site in Washington, D.C. The site was characterized by 20 to 30 feet of soft clay and clayey sand underlain by dense sand or hard clay. The embodiment of the present invention at the site was used to support mechanically stabilized earth (MSE) walls and embankments. The mandrel used for this project was similar to that used in Example II. The lower chamber in this embodiment had a nominal 18 inch diameter outer dimension. In this example, two fully concrete EBP were constructed and subsequently load tested. In this example of the embodiment, the EBP were constructed with a 24 inch diameter expanded base, and an 18 inch diameter shaft.

In this embodiment of the invention, the EBP was formed by filling the mandrel (such as in FIG. 7 or FIG. 8) with concrete. The full mandrel was then advanced to a depth of 26 feet below the ground surface for Test Pier 1 and to a depth of 36.5 feet below the ground surface for Test Pier 2. The mandrel was then raised 4 feet, and then lowered 3 feet. The process of raising the mandrel 4 feet, and then lowering 3 feet was completed for a total of 4 cycles at the test piers to create an expanded base. After the expanded base was created, the mandrel was extracted at a constant rate while pumping concrete into the mandrel. Once the concrete had cured, each of the piers was load tested.

Figure 10:
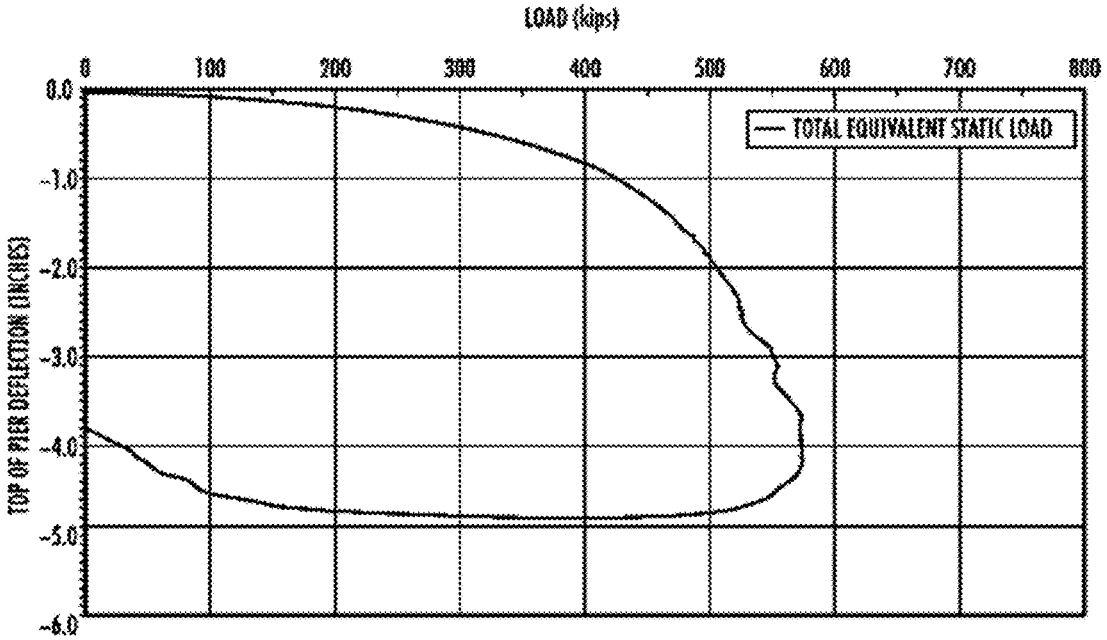
FIGS. 10 and 11 are graphs showing results of load tests performed on columns made according to Example III.
Figure 11:
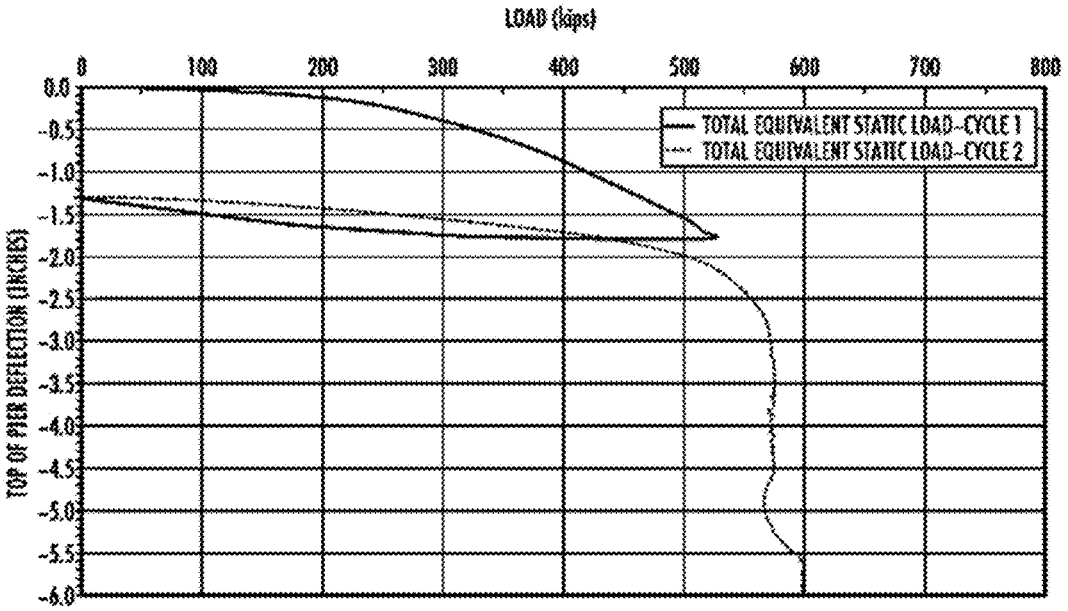
Figures 12A, 12B, 12C, 12D, 12E:
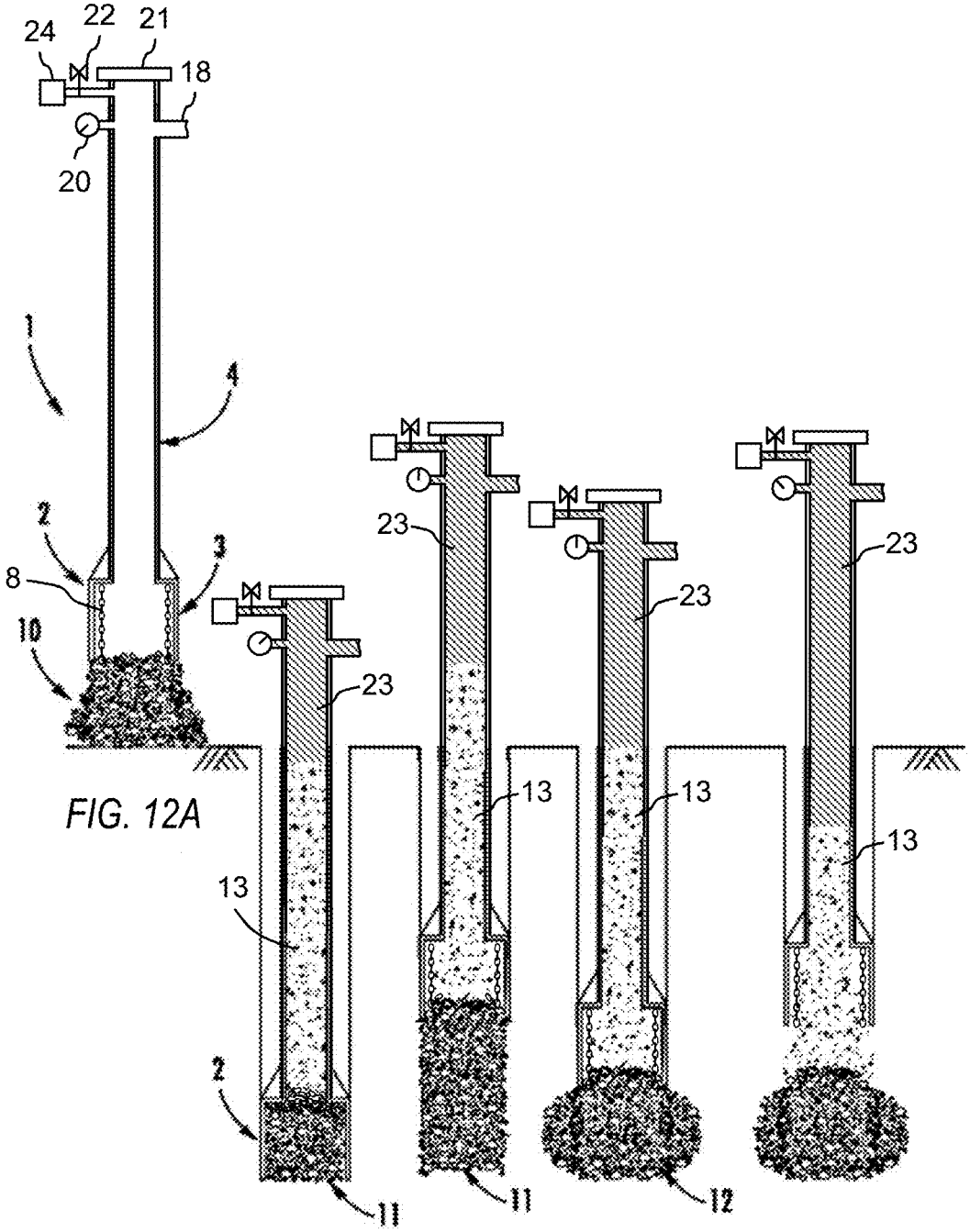
FIGS. 12A-12E illustrate a method of constructing a pier with the mandrel of FIG. 8 according to Example IV.

The load tests were performed using Statnamic load test methods. FIG. 10 shows the results of the load test on Test Pier 1 (26 feet below ground surface) and FIG. 11 shows the results of the load test on Test Pier 2 (36.5 feet below the ground surface—two test load cycles on this test pier). Both Test Pier 1 and Test Pier 2 supported a test load of approximately 425 kips at 1 inch of top of pier deflection, with a maximum supported load of approximately 575 kips.

EXAMPLE IV

As yet another example, a method of use is shown with reference to FIGS. 12A-12E, which shows an installation sequence with the base mandrel depicted in FIG. 8. The method shown in FIGS. 12A-12E uses air pressure measurements to determine the volume of concrete or aggregate that is flowed both into and out of the mandrel. In FIGS. 12A-12E, the mandrel assembly (1) includes the chain links (8), the air pressure gage (20) and the air source (24) supplying an air input port (25) near the top of the feed pipe (4).

During installation, mandrel air pressure and volumes of pumped concrete were recorded for each installation step. The results of the measurements are shown by the data labeled "Measured Pressure" in FIG. 13. The measurements were then compared to the theoretical or pressure/volume relationship (labeled "Theoretical Pressure") for ideal gasses represented by the equation: $PV=nRT$, wherein P is air pressure, V is air volume, n is number of moles of air (constant), R is a constant, and T is temperature in degrees Kelvin. The volume (V) of air inside the mandrel at any step may be determined by the initial mandrel volume less the volume of pumped concrete and adjusted for the volume of concrete placed during construction. Once the air volume in the mandrel is known, then the air pressure that should correspond to this volume can be computed. Similarly, once the pressure is measured, then the volume of air and concrete in the mandrel can be computed.

Figure 13:
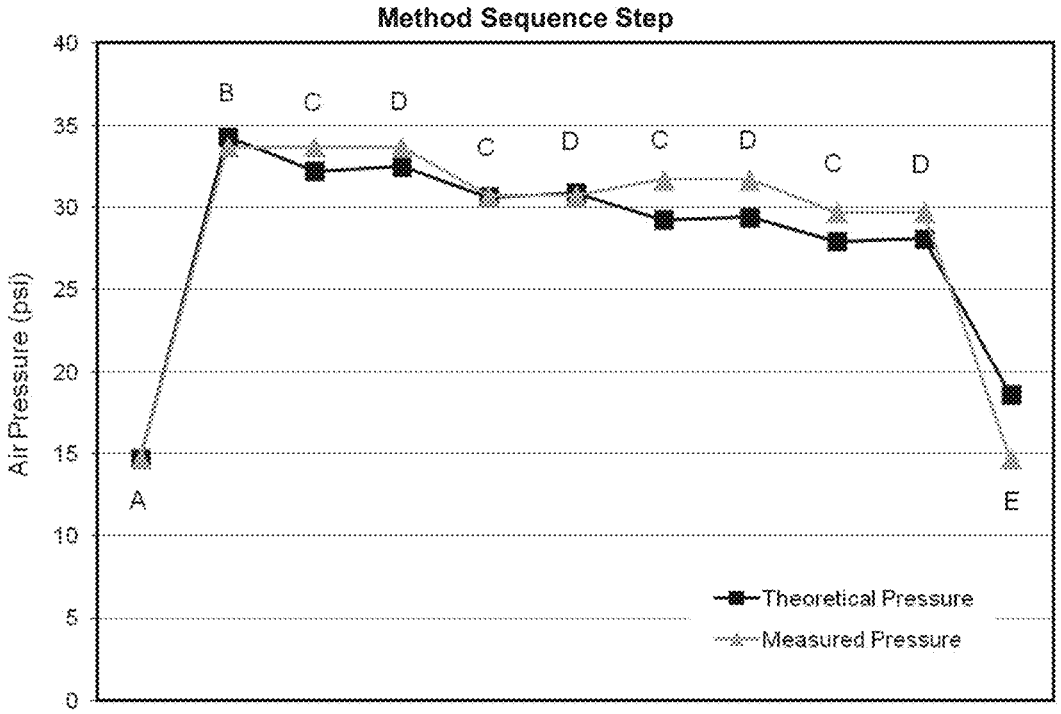
FIG. 13 is a graph showing measured and computed air pressures associated with the steps in the method according to Example IV.

Step A (FIG. 12A) shows placing a mound (10) of the aggregate on the ground surface (wherein the air pressure of air within mandrel feed pipe (4) is equal to atmospheric pressure, namely 14.7 pounds per square inch (psi), as shown in FIG. 13). Step B (FIG. 12B) shows driving the mandrel assembly (1) through the mound (10) of aggregate (to form an initial charge of aggregate) and to the final driving elevation. During the driving process, the aggregate and the "bunched" chain links (8) in the lower chamber (3) forms a plug (11) in the neck of the feed pipe (4) at the bottom of the tamper head (2). Further, grout or concrete (13) is pumped into the feed pipe (4) (see FIG. 8). A certain amount of trapped air (23), which is now under pressure, is within the mandrel feed pipe (4). The air pressure is measured at the end of this initial filling of the mandrel. The measured air pressure can be compared to the theoretical air pressure as shown on FIG. 13.

Step C (FIG. 12C) shows lifting of the mandrel assembly (1) wherein the aggregate plug (11) or initial charge remains in place at the bottom of the hole. Again, the mandrel feed pipe (4) includes both a volume of pressurized trapped air (23) and a volume of grout or concrete (13) wherein there is a drop in air pressure due to exiting of the aggregate. Step D (FIG. 12D) shows re-driving the mandrel assembly (1) to compact the aggregate at the bottom of the hole (with corresponding slight increase in air pressure). Steps C and D can be repeated one or more times to form an expanded base (12) (see repeated steps and measurements in FIG. 13). Grout or concrete (13) continues to be pumped through the feed pipe as shown. Step E (FIG. 12E) shows placing grout or concrete (13) for the element up from the bottom while removing the mandrel until air pressure in the mandrel again reaches atmospheric pressure.

During Steps C, D, and E, the pump strokes were measured to determine the volume of grout or concrete (13) flowed into the mandrel feed pipe (4) on the down stroke. Then, because the volume of the mandrel is known, the volume of air remaining in the mandrel was determined. Then, when the mandrel is pulled to the ground surface at the end of Step E, the volume of grout or concrete (13) placed was computed and the drop in air pressure was measured.

FIG. 13 shows excellent correlation between the measured and computed air pressures for each step indicating the veracity of the procedure. Thus, the present measuring system provides an excellent means of determining concrete volumes at every step in the process.

The foregoing detailed description of embodiments refers to the accompanying drawings, which illustrate specific embodiments of the invention. Other embodiments having different structures and operations do not depart from the scope of the invention. The term "the invention" or the like is used with reference to certain specific examples of the many alternative aspects or embodiments of the applicant's invention set forth in this specification, and neither its use nor its absence is intended to limit the scope of the applicant's invention or the scope of the claims. This specification is divided into sections for the convenience of the reader only. Headings should not be construed as limiting of the scope of the invention. The definitions are intended as a part of the description of the invention. It will be understood that various details of the invention may be changed without departing from the scope of the invention. Furthermore, the foregoing description is for the purpose of illustration only, and not for the purpose of limitation.

What is claimed is:

1. A method of constructing an expanded base pier with known expanded base volume, the method comprising:

(a) providing a mandrel assembly comprising a single-wall tube portion and a tamper head, the tube portion having an exterior diameter, wherein the tube portion is connected to the tamper head at an opening thereof for allowing flowable material to flow into the tamper head, and wherein the tamper head comprises a defined lower enlarged chamber having an interior diameter greater than the exterior diameter of the tube portion and further comprising a reducing surface at an upper portion thereof and comprising a plurality of chain links for compaction and for restricting upward flow of the flowable material into the tube portion during tamping, the tamper head further sized to provide an enclosed region for allowing the flowable material to be placed therein;

(b) providing a non-moveable sealed top plate on an end of the tube portion opposite the tamper head and a separate flowable material supply tube coupled to the tube portion via a sealed connection;

(c) providing a pressure gauge for monitoring air pressure within the tube portion;

(d) driving the mandrel assembly having an initial volume of the flowable material into a ground surface to a given depth thereby forming a cavity;

(e) lifting the mandrel assembly to release the initial volume of the flowable material from the tamper head into a bottom of the cavity while adding a secondary volume of flowable material;

(f) re-driving the mandrel assembly wherein the plurality of chain compact the initial and secondary volumes of flowable material at a bottom of the cavity and to form a unitary expanded base, the expanded base having a width greater than the width of the tamper head;

(g) measuring air pressure within the tube portion during the driving, lifting, and re-driving steps to determine a pressure drop indication;

(h) calculating a unitary expanded base volume based on the pressure drop indication and initial and secondary volumes added for comparison with a design expanded base volume; and (i) upon reaching the design expanded base volume, withdrawing the mandrel assembly while continuously discharging cementitious material from the tamper head, thereby forming, after curing, a stiff cementitious inclusion having a width substantially equal to the width of the cavity and being formed above the expanded base.

2. The method of claim 1 wherein the tamper head is filled with the initial charge of the flowable material before driving.

3. The method of claim 1, further comprising introducing the flowable material into the enclosed region.

4. The method of claim 1, further comprising providing the mandrel assembly with a second tube adjacent the tube portion and fluidly connected to the enlarged chamber to allow for an inspection of the flowable material during pumping.

5. The method of claim 1 further comprising an air pressure source connected to the tube portion for evacuating flowable material from the tube portion through air pressure supplied thereto.

6. The method of claim 1 wherein the flowable material comprises one or more of aggregate, concrete, grout, and cementitious material.

7. The method of claim 1 further comprising providing an air pressure release valve for reducing pressure in the tube portion.

8. The method of claim 1 further comprising providing a pressure gauge for monitoring pressure within the tube portion.

* * * * *